US012687023B1

(12) United States Patent
Moss

(10) Patent No.: US 12,687,023 B1
(45) Date of Patent: Jul. 21, 2026

(54) PORTABLE STAIRCASE

(71) Applicant: Everett Moss, Bakersfield, CA (US)

(72) Inventor: Everett Moss, Bakersfield, CA (US)

( * ) Notice: Subject to any disclaimer, the term of this patent is extended or adjusted under 35 U.S.C. 154(b) by 501 days.

(21) Appl. No.: 18/368,522

(22) Filed: Sep. 14, 2023

Related U.S. Application Data

(60) Provisional application No. 63/426,163, filed on Nov. 17, 2022, provisional application No. 63/406,714, filed on Sep. 14, 2022.

(51) Int. Cl.
*E04F 11/04* (2006.01)
*E04F 11/18* (2006.01)

(52) U.S. Cl.
CPC ..... *E04F 11/04* (2013.01); *E04F 11/1817* (2013.01)

(58) Field of Classification Search
CPC ..... E04F 11/04; E04F 11/1817
USPC ..... 14/69.5–71.1; 52/191
See application file for complete search history.

(56) References Cited

U.S. PATENT DOCUMENTS

| | | | | |
|---|---|---|---|---|
| 1,165,588 | A | 12/1915 | Garraway | |
| 2,523,535 | A | 9/1950 | Little | |
| 6,089,350 | A | 7/2000 | Hankins | |
| 6,955,243 | B1 | 10/2005 | Huff | |
| 8,418,809 | B2 | 4/2013 | Donlon | |
| 10,407,916 | B1 * | 9/2019 | Samad | E04F 11/1817 |
| 11,125,015 | B2 | 9/2021 | Goudreault | |
| 2006/0169535 | A1 | 8/2006 | Phillips et al. | |
| 2006/0254856 | A1 | 11/2006 | Kuniewich et al. | |
| 2007/0284189 | A1 | 12/2007 | Chady | |
| 2008/0011549 | A1 | 1/2008 | Lott | |
| 2008/0190049 | A1 * | 8/2008 | Muti | E04G 27/00 52/183 |
| 2010/0051384 | A1 | 3/2010 | Currie | |
| 2010/0147623 | A1 | 6/2010 | Pocos | |
| 2012/0167521 | A1 | 7/2012 | Cretti | |
| 2013/0198978 | A1 * | 8/2013 | Pohlman | E01D 1/00 29/428 |
| 2014/0001333 | A1 | 1/2014 | Stephen | |
| 2015/0376946 | A1 | 12/2015 | Kurzer et al. | |

(Continued)

FOREIGN PATENT DOCUMENTS

| | | | |
|---|---|---|---|
| AU | 2008100330 | A4 * | 7/2008 |
| CN | 209443687 | U * | 9/2019 |

(Continued)

OTHER PUBLICATIONS

CN111622436B English machine-generated translation of abstract. Retrieved from "https://translationportal.epo.org/emtp/translate/?ACTION=abstract-retrieval&COUNTRY=CN&ENGINE=google&FORMAT=docdb&KIND=B&LOCALE=en_EP&NUMBER=111622436&SRCLANG=zh&TRGLANG=en" on Sep. 13, 2022.

(Continued)

*Primary Examiner* — Raymond W Addie
(74) *Attorney, Agent, or Firm* — Sierra IP Law, PC; William K. Nelson

(57) ABSTRACT

An improved portable staircase for assisting workers in excavation sites to ascend and descend safely without the needed use of handrail for workers to safely ascend and descend trenches in excavation sites, tunnels, and the like without using a handrail. The portable staircase includes a plurality of steps (e.g., treads) nested between at least two rails. Each of the rails may have a securing system at their upper and lower ends that are operable to rigidly secure the staircase to the ground.

20 Claims, 10 Drawing Sheets

(56) References Cited

U.S. PATENT DOCUMENTS

| | | | |
|---|---|---|---|
| 2016/0369563 | A1 | 12/2016 | Adcock et al. |
| 2019/0128066 | A1 | 5/2019 | Tombragel et al. |
| 2020/0087985 | A1 | 3/2020 | Polzen |

FOREIGN PATENT DOCUMENTS

| | | | | | |
|---|---|---|---|---|---|
| CN | 111622436 | B | | 6/2021 | |
| CN | 114856103 | A | * | 8/2022 | ..... E04F 11/1817 |
| DE | 20119304 | U1 | * | 4/2002 | ..... E04F 11/1834 |
| GB | 2432621 | A | | 5/2007 | |
| JP | 2004263514 | A | | 9/2004 | |
| KR | 200308583 | Y1 | | 3/2003 | |
| KR | 20120000245 | A | | 1/2012 | |
| RU | 195866 | U1 | | 2/2020 | |
| WO | WO-2008138041 | A1 | * | 11/2008 | ..... E04G 27/00 |

OTHER PUBLICATIONS

CN111622436B original document. Retrieved from "https://worldwide.espacenet.com/patent/search/family/072258196/publication/CN111622436B?q=pn%3DCN111622436B" on Sep. 13, 2022.

GB2432621A original document. Retrieved from "https://worldwide.espacenet.com/patent/search/family/035601181/publication/GB2432621A?q=pn%3DGB2432621A" on Sep. 13, 2022.

JP2004263514A English abstract. Retrieved from "https://worldwide.espacenet.com/patent/search/family/033120721/publication/JP2004263514A?q=pn%3DJP2004263514A" on Sep. 13, 2022.

JP2004263514A original document. Retrieved from "https://worldwide.espacenet.com/patent/search/family/033120721/publication/JP2004263514A?q=pn%3DJP2004263514A" on Sep. 13, 2022.

KR200308583Y1 English machine-generated translation of abstract. Retrieved from "https://translationportal.epo.org/emtp/translate/?ACTION=abstract-retrieval&COUNTRY=KR&ENGINE=google&FORMAT=docdb&KIND=Y1&LOCALE=en_EP&NUMBER=200308583&SRCLANG=ko&TRGLANG=en" on Sep. 13, 2022.

KR200308583Y1 original document. Retrieved from "https://worldwide.espacenet.com/patent/search/family/049332185/publication/KR200308583Y1?q=pn%3DKR200308583Y1" on Sep. 13, 2022.

KR20120000245A English abstract. Retrieved from "https://worldwide.espacenet.com/patent/search/family/045608154/publication/KR20120000245A?q=pn%3DKR20120000245A" on Sep. 13, 2022.

KR20120000245A original document. Retrieved from "https://worldwide.espacenet.com/patent/search/family/045608154/publication/KR20120000245A?q=pn%3DKR20120000245A" on Sep. 13, 2022.

RU195866U1 English machine-generated translation of abstract. Retrieved from "https://translationportal.epo.org/emtp/translate/?ACTION=abstract-retrieval&COUNTRY=RU&ENGINE=google&FORMAT=docdb&KIND=U1&LOCALE=en_EP&NUMBER=195866&SRCLANG=ru&TRGLANG=en" on Sep. 13, 2022.

RU195866U1 original document. Retrieved from "https://worldwide.espacenet.com/patent/search/family/069416463/publication/RU195866U1?q=pn%3DRU195866U1" on Sep. 13, 2022.

* cited by examiner

PORTABLE STAIRCASE

FIELD OF THE INVENTION

The present invention relates to portable staircases comprising fasteners operable to secure said staircase into the ground in order to safely ascend and descend excavation sites. A plurality of portable staircases may be fashioned together to reach a desired height or length and may secure various staircase attachments.

BACKGROUND OF THE INVENTION

There is a need for a device that allows construction workers to walk up and down trenches in excavation sites. It is desired that the present invention is able to have foldable steps/treads big enough to step where a handrail is not needed to safely ascend or descend from heights. It is also desirable that the device is lightweight, durable, and collapsible in order to store or transport quickly. It is further desirable for the device to be operable to accept another device of the same using a locking mechanism to achieve the desired height. It is further desirable for the device to quickly be secured and unsecured with fasteners in case of changing of location in any abrupt moment.

The Occupational Safety and Health Administration (OSHA) provides regulations to ensure safe and healthful working conditions for workers by setting and enforcing standards in the workplace. The Occupational Safety and Health Standards 1910.25 outlines the standards for Walking-Working surfaces and specifically stairways.

Prior devices involving ladders do not work well for meeting the above-described needs for several reasons. Firstly, walking up and down a ladder without holding onto said ladder can be dangerous and would violate OSHA regulations. Second, ladders do not have steps/treading that are big enough to step on without using the ladder side rails for support. Thirdly, staircases used in construction zones are stationary or take a while to set up and disassemble to move to another location.

It is known that workers at excavation sites carry items up and down the trenches using a ladder or inclined hill. Carrying items while climbing a ladder or inclined hill can be dangerous due to its steep angle. While there are prior art apparatuses to ascend and descend from different heights, they all fall short based on the attributes described above. It is desirable to provide an improved portable staircase for use in tunnels, excavations, earthen ramps, and the like without the needed use of a handrail for support.

SUMMARY OF THE INVENTION

The invention provides an improved portable staircase system for workers to safely ascend and descend trenches in excavation sites, tunnels, and the like without using a handrail. The portable staircase includes a plurality of steps (e.g., treads) nested between at least two rails. Each of the rails may have a securing system at their upper and lower ends that are operable to rigidly secure the staircase to the ground. The securing system in some embodiments, is operable to attach an adjacent portable staircase rails together to increase the total length of the staircase. The fasteners in the system may include anchoring nails but may include other fastening devices like nut and bolts, anchors, pivoting stakes, and rivets. In some embodiments, straps (e.g., ratchet straps, tensioner straps) may be used in combination with the fastener devices listed. In other embodiments, the portable staircase may have a collapsible body allowing it to be stored and transported easily. For example, the portable staircase unit may include a hinge joints along its length in the side rails to allow the portable staircase to be folded on itself.

In some implementations, the portable staircase may be fixed at a 30° angle where the slope of the staircase is constant. This arrangement can be used for excavation sites that regularly use the same slopes at different job sites. A fixed, portable staircase allows workers to set up a portable staircase much faster. It shall be known that the steps of the portable staircase must be at greater than 30 about degrees and less than about 50 degrees (e.g., in a range of about 40° to about 50°, about 45°) not to use a handrail. This is to meet OSHA regulations for staircases.

In some embodiments, the upper and lower side rail members may have a attachment conduit that is operable to receive and secure various attachments to the staircase. The attachment conduit may be constructed from metal tubing (e.g., galvanized steel, steel, stainless steel, aluminum, and etc.) and may have a square, circular, rectangular or common tubing geometry. The various attachments may include a handrail, landing, stringers, guides, etc. and may include an attachment anchor with a geometry that complements the attachment conduit. The attachments may secure to the attachment conduit with a locking mechanism such as a clamp, clip, threaded fastener (e.g., nut and bolt). In some embodiments, a handrail may be required to allow workers to ascend and descend from heights with additional support. This may be appropriate for when slopes do not fall into OSHA regulations.

It is an aspect of the present invention to provide a portable staircase operable to rapidly and temporarily deploy and secure to the ground and provide workers with egress and ingress to an excavation site, the portable staircase comprising: a pair of siderails having a lower end and an upper end, each end having an anchoring system operable to secure the siderails to the ground; a plurality of steps attached between the pair of siderails; and a plurality of attachment conduits operable to receive a plurality of staircase attachments; wherein the anchoring system may be operable to connect a first portable staircase siderails to a second portable staircase siderails. The siderails may be positioned at a constant angle ranging from about 30° to 50° with respect to the ground (e.g., in a range of about 40° to about 50°, about 45°). The plurality of steps may have a riser height ranging from 6.5 inches to 10 inches and a tread run ranging from 11 inches to 8 inches. The anchoring system may include a through hole positioned at the upper end and the lower end of the siderail that are operable to align and secure a fastener. The fastener may be an anchoring nail or a threaded nut and bolt. The plurality of attachment conduits may be positioned along a length of the siderail opposite to the steps and may be operable to align the plurality of staircase attachments. The attachment conduits may have a fastener system operable to secure the plurality of staircase attachments. The plurality of staircase attachments are different attachments secured to the staircase. The attachment conduit is a tube and said staircase attachments have a tube with a complementary geometry for aligning with the staircase. The different attachments may include a handrail or a landing. The steps may have a top surface with an anti-slip material.

It is a further aspect of the present invention, to provide a method for deploying a plurality of portable staircases to assist workers ascending and descending from trenches in excavation sites, the method comprising: a portable staircase including a plurality of steps secured between two siderails, each of the siderails having an upper-end rail and a lower-end rail with a fastening system operable to align a fastener; aligning a first portable staircase upper-end rail with a second portable staircase lower-end rail and securing the first and second portable staircases together with the fastening system; securing a first portable staircases lower-end rail to a base surface of a trench with an anchoring fastener; and securing the second portable staircase upper-end rail to an upper surface of a trench with an anchoring fastener; wherein a plurality of portable staircases may be secured between the first and second portable staircase. The portable staircases further comprise a plurality of attachment conduits positioned along a length of the siderails. The plurality of portable staircases may be secured between said first and second portable staircases by attaching the siderail upper end to the siderail lower end of adjacent portable staircases. The fastening system includes a locking clamp, locking latches, fitted coupling, or nut and bolt fastener. The attachment conduits may be operable to align and secure a handrail attachment to said siderail with a fastener. The securing of the second portable staircase upper-end rail to an upper surface of a trench with an anchoring fastener attached to a landing attachment. The landing attachment secures to the upper-end rail and includes a ground anchor. The steps may have a textured surface to prevent a user from slipping. The staircases may have a size that is operable to fit in the bed of a pickup truck.

Further aspects and embodiments will be apparent to those having skill in the art from the description and disclosure provided herein.

It is an object of the present invention to provide a portable staircase allowing workers to safely ascend and descend trenches in excavation sites with the use of a fastening system to secure said portable staircase.

It is a further object of the present invention to provide side rails operable to accept additional attachments such as aluminum tubing and a hand rail. The aluminum tubing comprises of a locking mechanism such as a clamp which can link and secure a pair of portable staircases. The handrail can be an additional attachment incorporated into the staircase, e.g., when a slope is greater than 50°. The handrail can also be used when additional support is when wanted when ascending and descending the excavation site.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1:
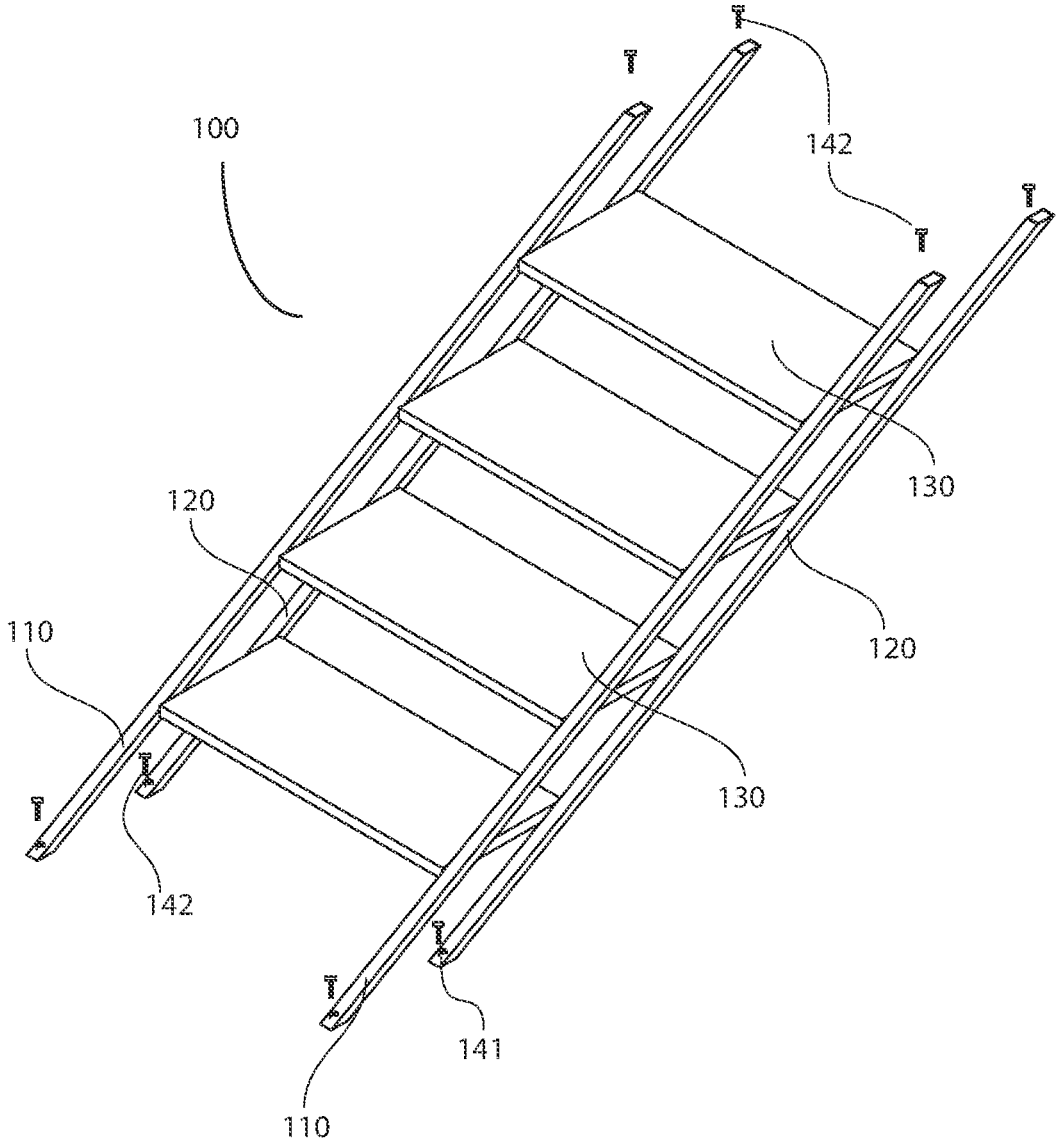
FIG. 1 provides a perspective view of a portable staircase apparatus, according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

Referring to the drawings, wherein like reference characters designate like or corresponding parts throughout the several views, and referring particularly to FIGS. 1-9, it is seen that the present invention includes various embodiments of a portable staircase for allowing workers to ascend and descend trenches in excavation sites safely.

Figure 2:
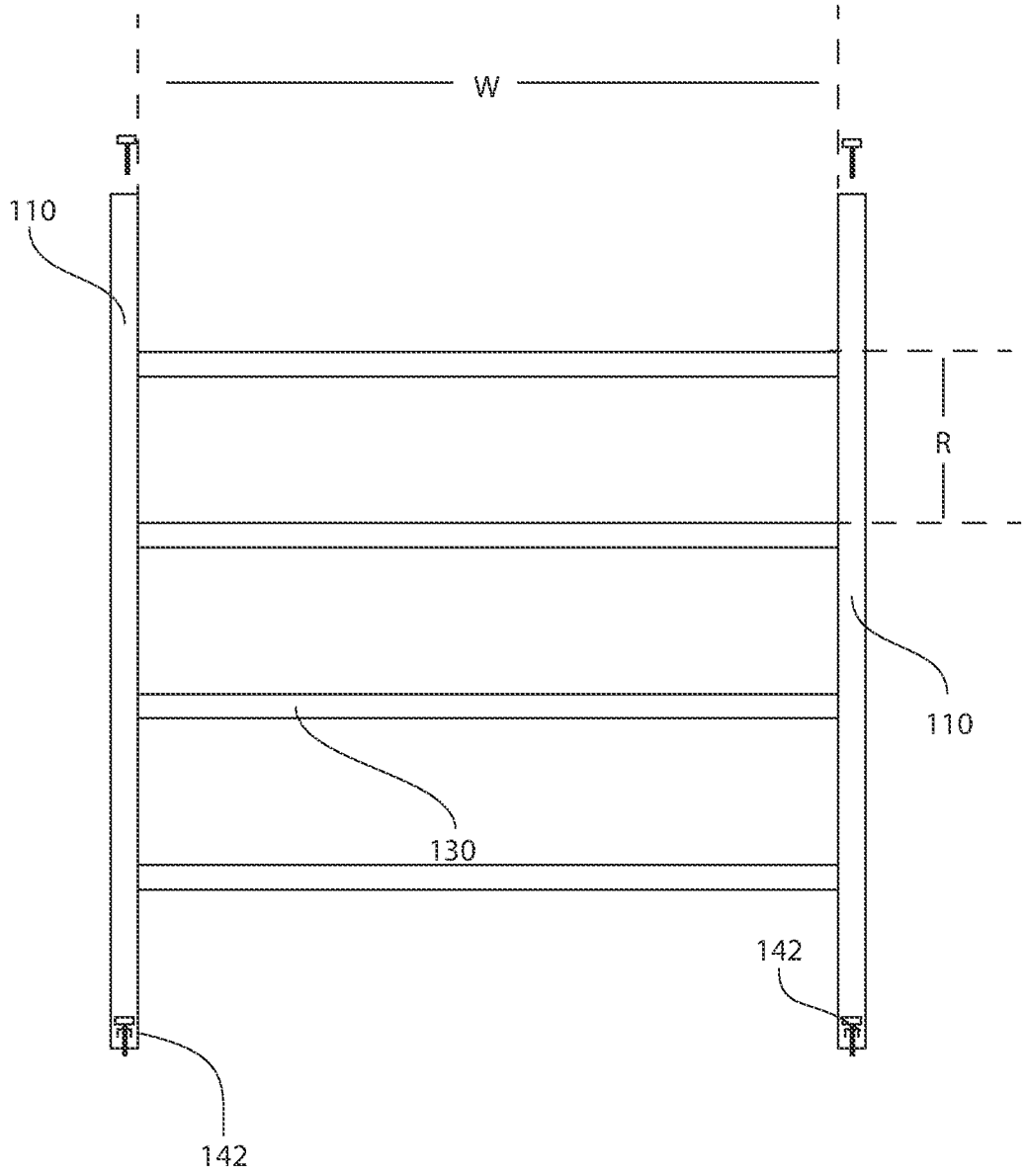
FIG. 2 provides a frontal view of a portable staircase apparatus, according to an embodiment of the present invention.
Figure 3:
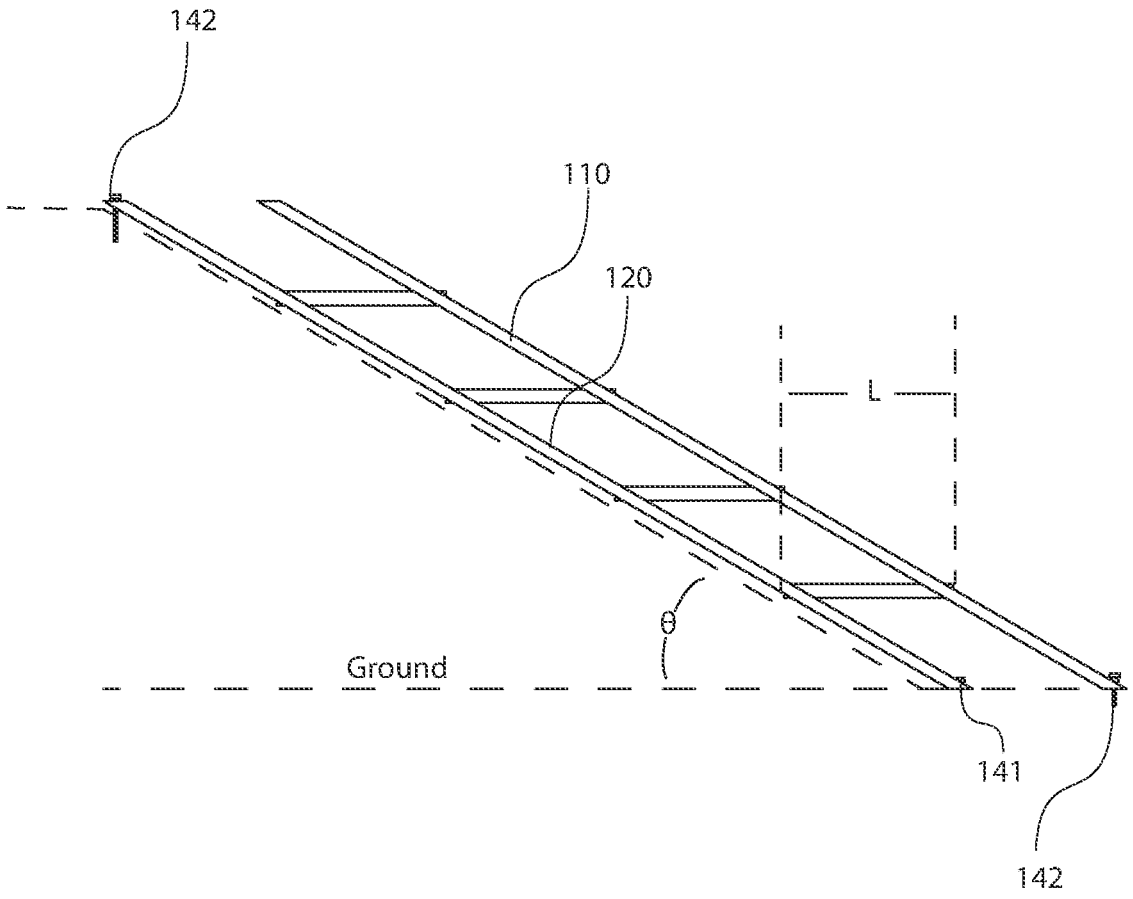
FIG. 3 provides a side view of a portable staircase apparatus, according to an embodiment of the present invention.
Figure 4:
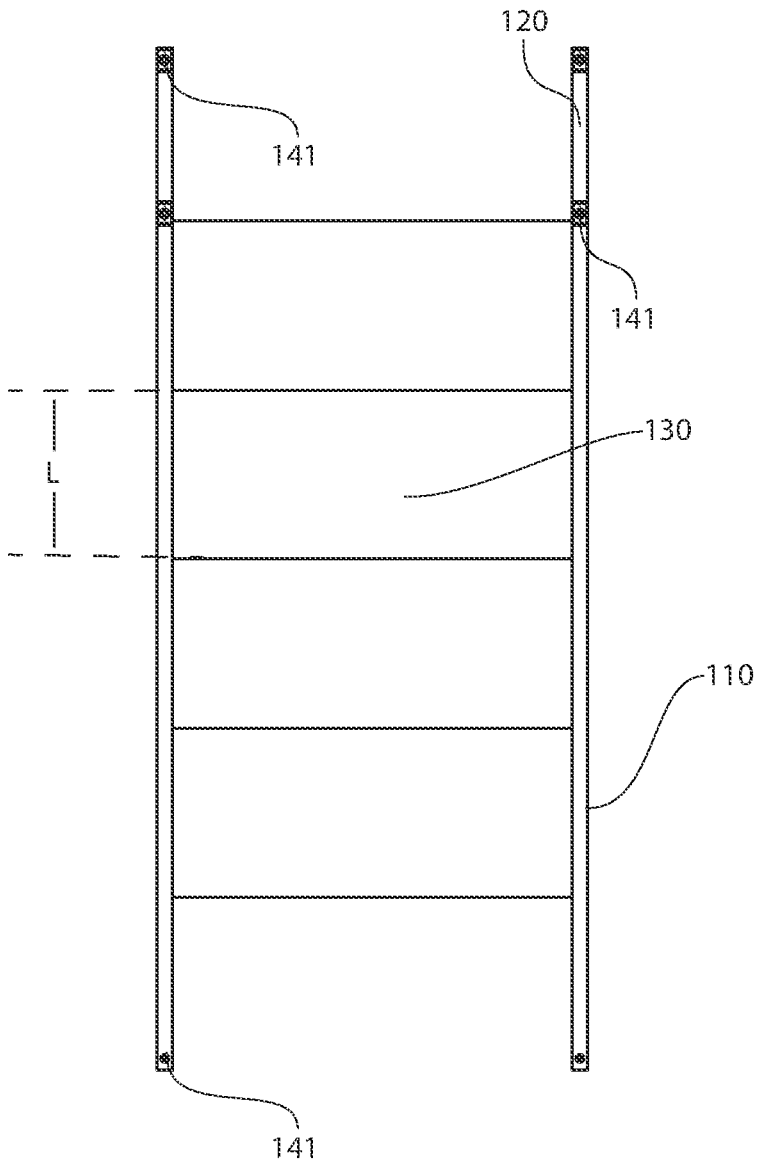
FIG. 4 provides a top view of a portable staircase apparatus, according to an embodiment of the present invention.

The present invention concerns a portable staircase 100. FIG. 1. provides a front perspective of the portable staircase 100 comprising a forward siderail 110 and a rear siderail 120, securing a plurality of steps 130. The siderails 110, 120 may have a securing system at a bottom end and a top end that includes a through hole 141 operable to receive an anchor 142. In some embodiments, multiple portable staircases 100 may be linked together by using securing a first staircase 100 to the ground and the bottom end through hole 141 of a second staircase to the top end through hole 141 of the first staircase, with a threaded fastener and a bolt 142. FIG. 3 provides an exemplary side view of the staircase 100 secured to the ground (e.g., dotted line). The staircase 100 angle θ relative to the horizontal ground may range from 30° to 50° (e.g., in a range of about 40° to about 50°, about 45°). The height of step rise R may range from about 6.5 in-9.5 and the width W may have a standard minimum width of about 22 in, as shown in FIG. 2. The width W may also define the distance from a pair of side rails 110, 120. As shown in FIGS. 3 and 4 the tread length L (e.g., run) may range from about 8 in. to about 11 in. The tread length L and riser height R of the steps 130 may correspond to the standards set by OSHA (e.g., Standard Number 1910.25(c)(5)) and may be dependent on the angle θ of the siderails 110, 120 relative to the horizontal ground. In some embodiments, the steps 130 may anti-slip top surface treading that provides friction on the walking surface to prevent a user from slipping on the step 130. Treading may be provided, for example, as an anti-slip tape, sandpaper, or rubberized material that is secured to the top surface with an adhesive. In other embodiments, the stair treads may include perforated metal surfaces and edges, for example, countersunk perforation and upturned perforations, pearl step grips, stable step, garden step grips, serrated perforation and etc., A combination of rubberized, anti-slip tape, and perforated metal surfaces may be used on the top surface of the steps 130.

Figure 5:
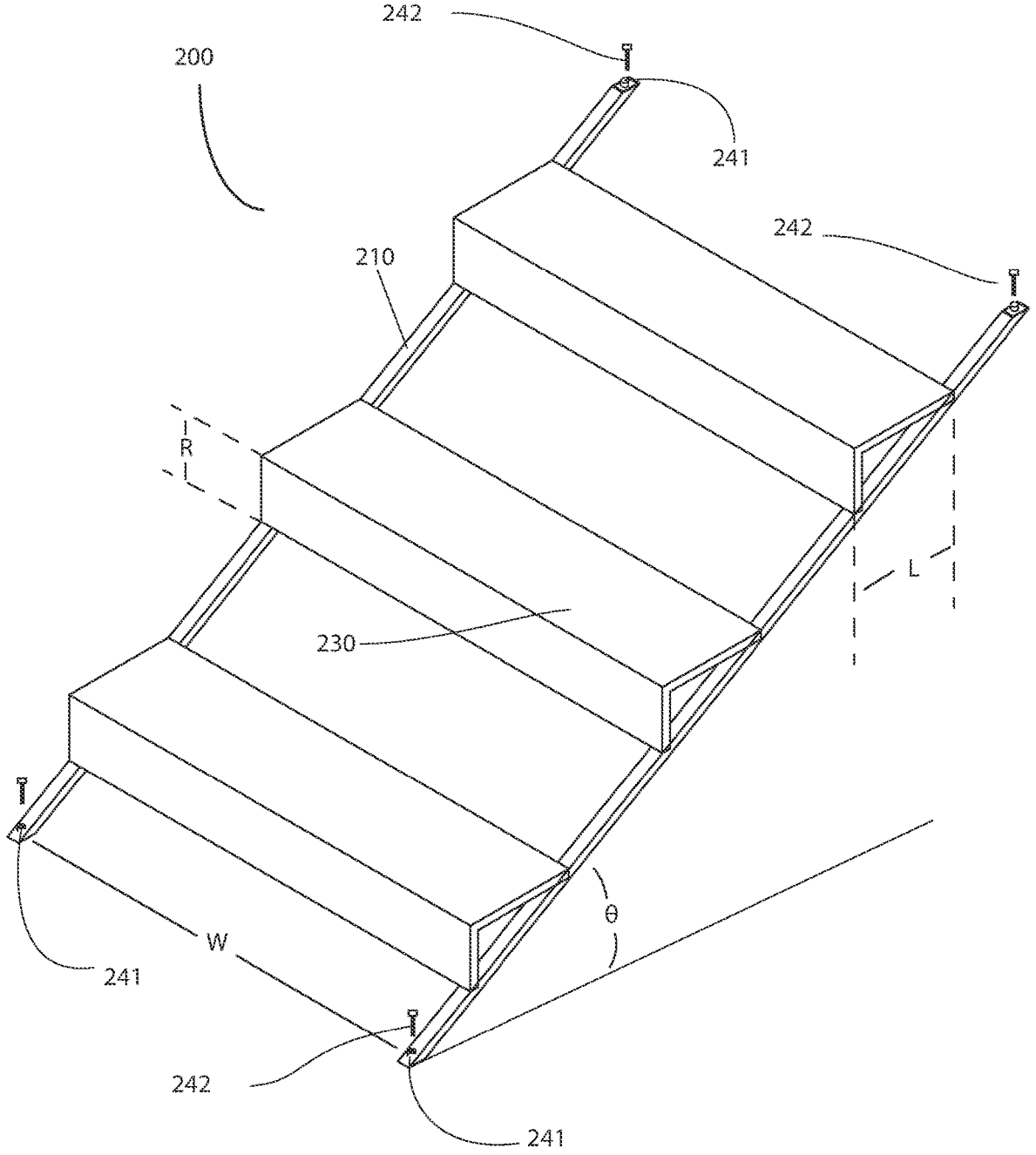
FIG. 5 provides a perspective view of a portable staircase apparatus, according to an embodiment of the present invention.
Figure 6:
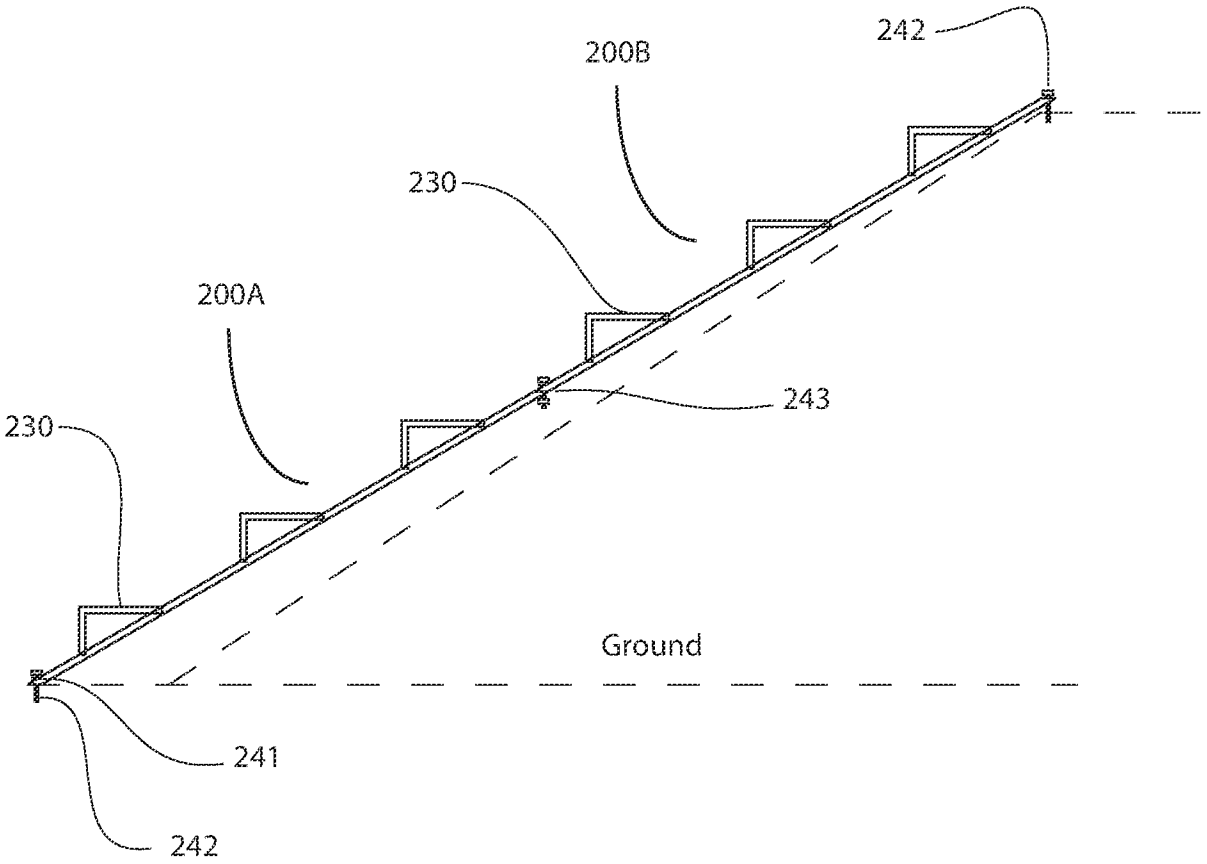
FIG. 6 provides a side view of two portable staircase apparatus joined together, according to an embodiment of the present invention.
Figure 7:
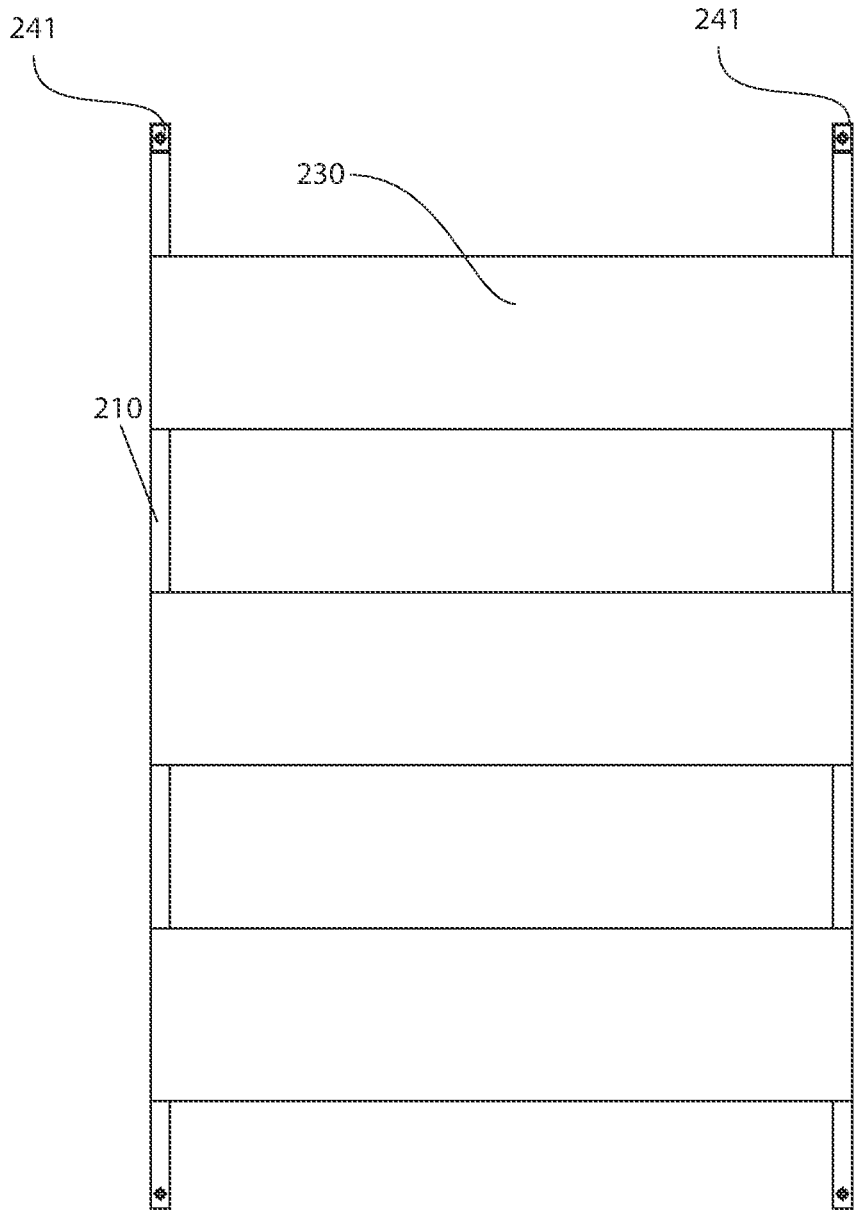
FIG. 7 provides a top view of a portable staircase apparatus, according to an embodiment of the present invention.

In some embodiments, as illustrated in FIGS. 5-7, the portable staircase 200 may have only one side rail 210 and the steps 230 may be positioned on the upper surface of the side rail 210. In such embodiments, the step 230 Length L, riser height R, width W and angle θ of the side rail 230 relative to the ground may be consistent with the dimensions of the portable staircase 100 of FIGS. 1-4 described above. The ends of the side rail 210 may have a through hole 241 operable to receive a fastener or anchor 242. FIG. 6 provides an exemplary environmental view of a first portable staircase 200A and a second portable staircase 200B attached together to increase the overall length of the staircase. The upper through hole 241 of the first portable staircase 200A may align with the lower through hole 241 of the second portable staircase 200B and locking mechanism 243 (e.g., nut and bolt, latches, locks, links, and etc.) may secure the two staircases together. The first portable staircase 200A may be anchored to the lower ground surface with a fastener 242 (e.g., ground anchor). The upper through hole 241 of the second portable staircase 200B may be secured to the top surface of the ground with a ground fastener 242.

Figure 8:
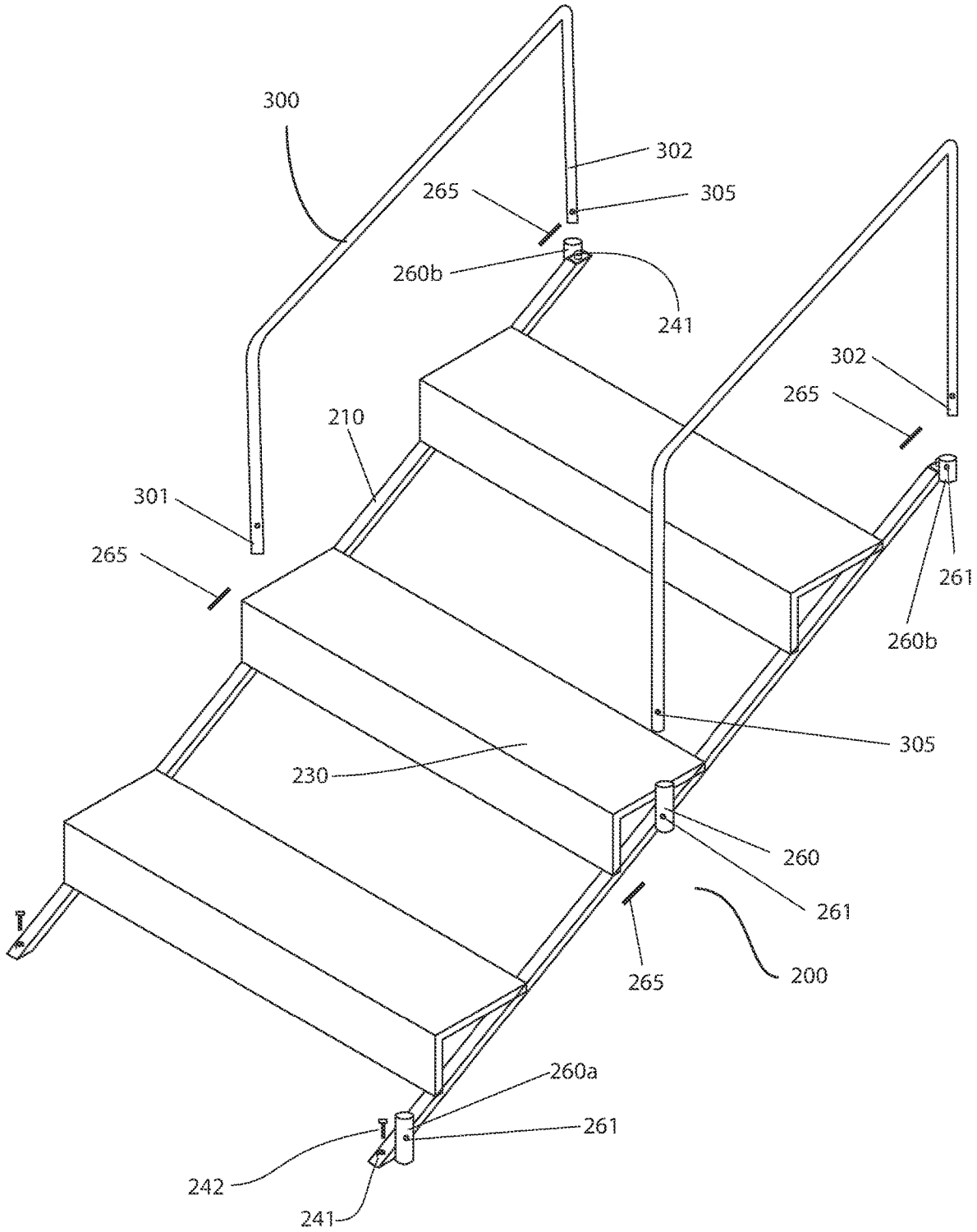
FIG. 8 provides a perspective view of a portable staircase apparatus including a handrail attachment, according to an embodiment of the present invention.
Figure 9:
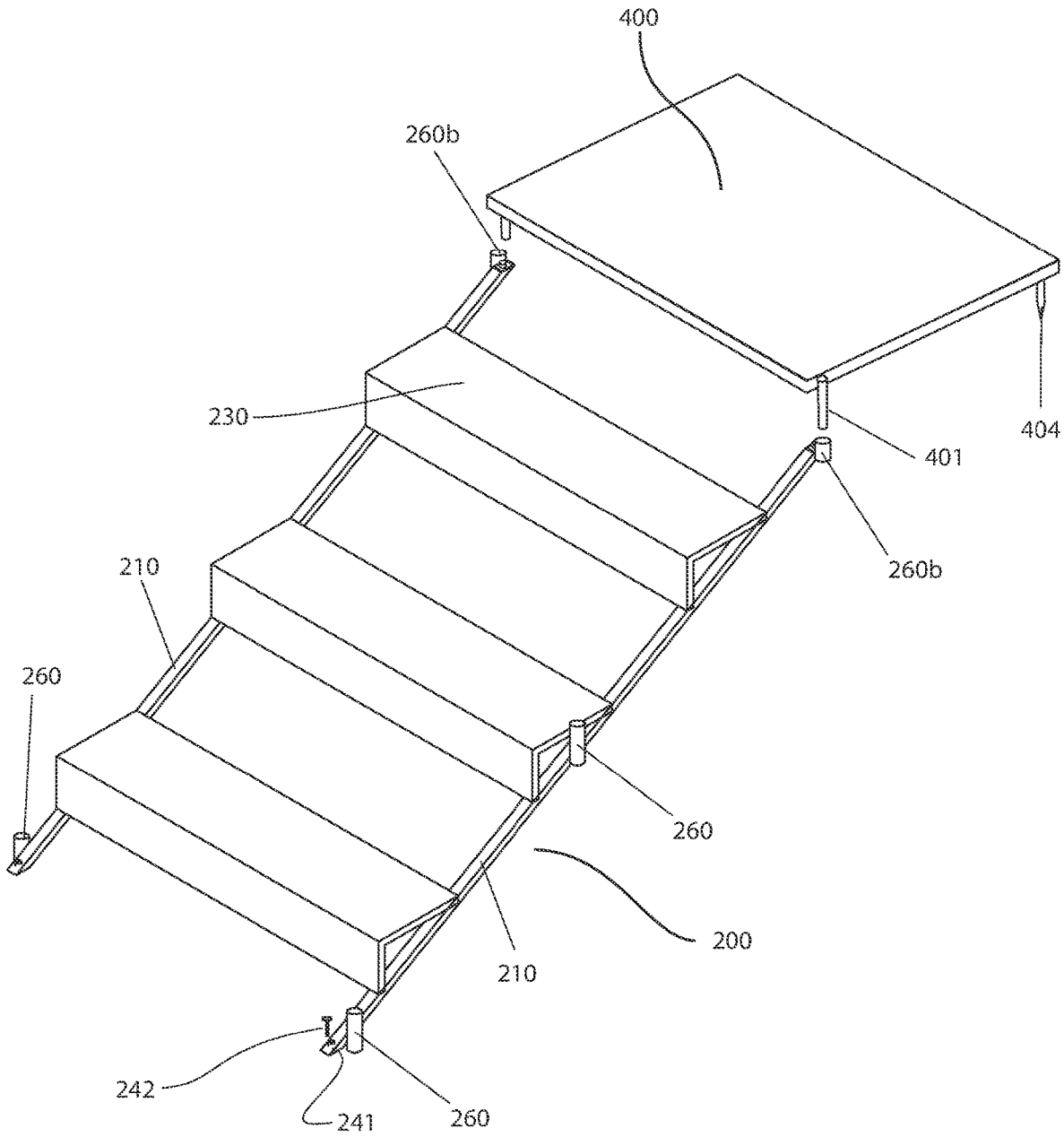
FIG. 9 provides a perspective view of a portable staircase apparatus including a landing attachment, according to an embodiment of the present invention.

In some embodiments, the portable staircase 200 may have a plurality of attachment conduits 260 secured to the outside of the siderail 210, as shown in FIGS. 8 and 9. An upper attachment conduit 260*b* may be positioned adjacent to the through hole location 241 at the top of the staircase 200 and a lower attachment conduit 260*a* may be positioned adjacent to the through hole location 241 at the bottom of the staircase 200. Additional attachment conduits 260 may be at any location along the length of the siderail 210. Each of the attachment conduits 260 may have a through hole 261 that is operable to receive a fastener 265 and temporarily secure an attachment to the staircase 200. FIG. 8 provides a handrail attachment 300 having a first end 301 and second end 302, both ends may have geometry complementary to the attachment conduit 260 and may include a through hole 305 that is operable to position the handrail in the conduit and align with the attachment conduit through hole 261 for receiving the fastener 265. The handrails first end 301 may align with an attachment conduit 260 secured midway along the length of the siderail 210 and the handrail second end 302 may secure to the upper attachment conduit 260*b*.

FIG. 9 illustrates a landing attachment 400 having a forward anchor 401 that is operable to secure to the attachment conduit 260*b*. In some embodiment, the landing attachment 400 may include an outer anchor 404 operable to secure the landing to the ground. In some embodiments, the forward anchor 401 may align with the upper side rail through hole 241 thereby securing the landing and the staircase 200 to the elevated ground surface. In such embodiment, the landing attachment 400 and the handrail attachment 300 may both secure to the staircase 200 simultaneously.

Figure 10:
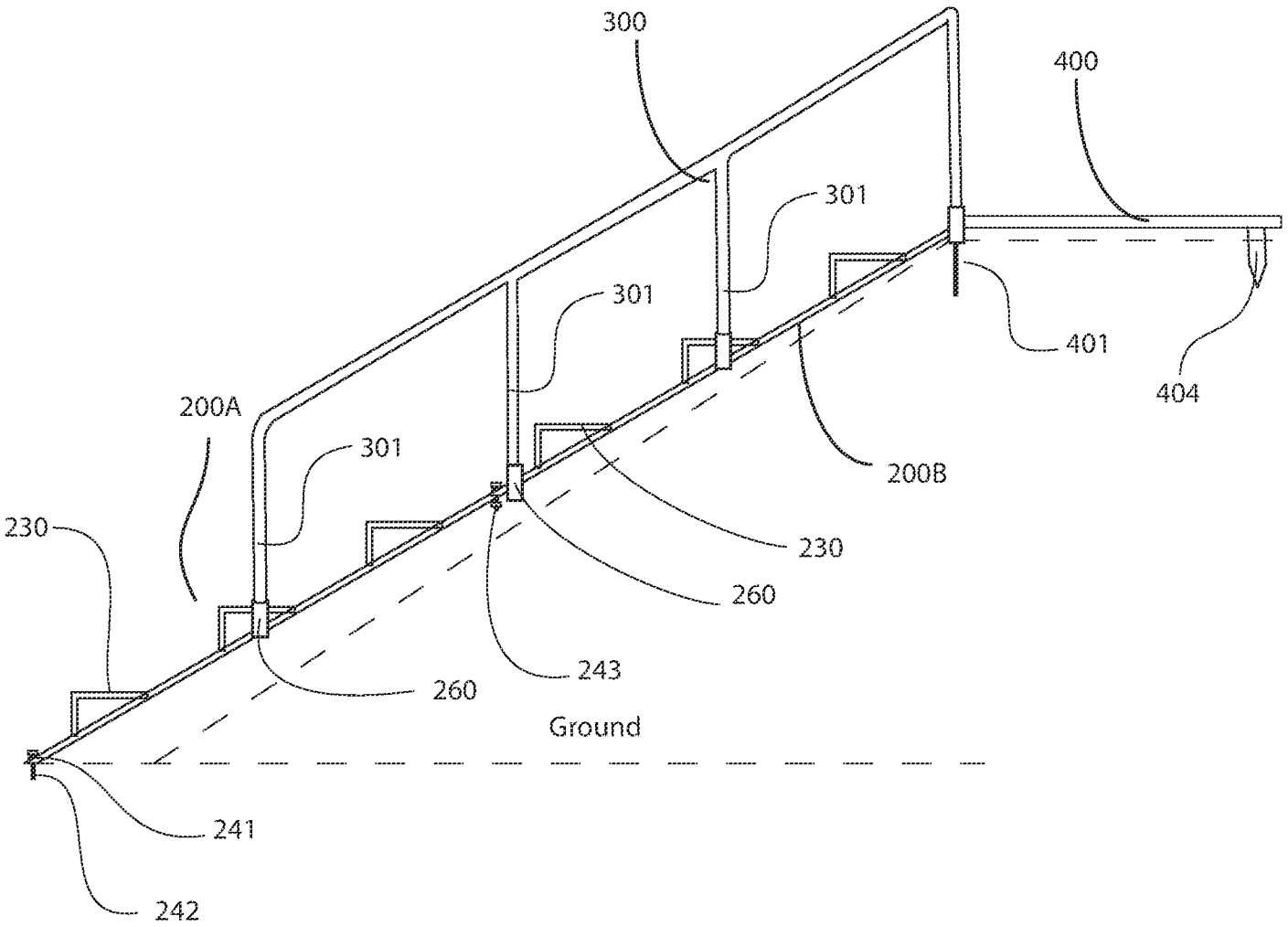
FIG. 10 provides an environmental side view of a two portable staircase joined together including a handrail attachment and a landing attachment, according to an embodiment of the present invention.

As shown in FIG. 10 a first staircase 200A and a second staircase 200B may have various attachment conduits 260 that may be fastened together with the locking mechanism 243. The upper through hole 241 (not visible) of the second staircase 200B may receive the landing anchor 401 and secure the landing 400 to the elevated ground surface 400. An elongated handrail 300 may have a plurality of ends 301 that align with the various attachment conduits 260 and are secured with the fastener 265.

The staircases 100, 200 of the present invention may be constructed from aluminum materials and the steps 130, 230 may temporary secure to the railing 110, 120, 210 with fasteners or may be permanently secured together by welding, brazing, etc. In some embodiments, a chain link may connect the upper end of a first staircase to the lower end of a second staircase to provide a safeguard in the event the locking mechanism 243 fails. It is to be appreciated that a plurality of staircases may link together to reach the desired height or distance required to traverse the excavation site trench, and that various attachments may be secured to either the upper or lower through holes or the attachment conduit. Only two staircases linking systems are described, but the attachment method for securing a first staircase to a second staircase can be applied to a third, fourth, etc. staircases.

CONCLUSION/SUMMARY

The present invention is portable, durable, collapsible, can accept a linking and locking attachment, and a handrail.

What is claimed is:

1. A portable staircase system operable to rapidly and temporarily deploy and secure to the ground and provide workers with egress and ingress to an excavation site, comprising:

a. a pair of siderails having a lower end and an upper end, each end having an anchoring system operable to secure the siderails to the ground;

b. a plurality of steps attached between said pair of siderails; and c. a plurality of attachment conduits operable to receive a plurality of staircase attachments;

wherein said anchoring system includes fasteners operable to pass through receivers in each siderail, and is operable to connect a first portable staircase siderails to a second portable staircase siderails.

2. The portable staircase of claim 1, wherein said siderails are positioned at a constant angle ranging from about 300 to about 50° with respect to the ground.

3. The portable staircase of claim 1, wherein said plurality of steps have a riser height ranging from 6.5 inches to 10 inches and a tread run ranging from 11 inches to 8 inches.

4. The portable staircase of claim 1, wherein each of said receivers a through hole positioned at said upper end and said lower end of said siderail that is operable to align and secure one of said fasteners.

5. The portable staircase of claim 4, wherein said fasteners are anchoring nails or threaded nuts and bolts.

6. The portable staircase of claim 1, wherein said plurality of attachment conduits are positioned along a length of said siderail opposite to said steps and are operable to align said plurality of staircase attachments.

7. The portable staircase of claim 6, wherein said attachment conduits have a fastener system operable to secure said plurality of staircase attachments.

8. The portable staircase of claim 6, wherein said plurality of staircase attachments are different attachments secured to the staircase.

9. The portable staircase of claim 6, wherein said attachment conduit is a tube and said staircase attachments have a tube with a complementary geometry for aligning with said conduit.

10. The portable staircase of claim 8, wherein said different attachments is a handrail or a landing.

11. The portable staircase of claim 1, wherein said steps have a top surface with an anti-slip material.

12. A method for deploying a plurality of portable staircases to assist workers ascending and descending from trenches in excavation sites, comprising:

a. a portable staircase comprising a plurality of steps secured between two siderails, each of said siderails having an upper-end rail and a lower-end rail with a fastening system operable to align a fastener;

b. aligning a first portable staircase upper-end rail with a second portable staircase lower-end rail and securing said first and second portable staircases together with said fastening system;

c. securing said first portable staircases lower-end rail to a base surface of a trench with an anchoring fastener; and d. securing said second portable staircase upper-end rail to an upper surface of a trench with an anchoring fastener;

wherein a plurality of portable staircases may be secured between said first and second portable staircase.

13. The method of claim 12, wherein said portable staircases further comprise a plurality of attachment conduits positioned along a length of said siderails.

14. The method of claim 12, wherein said a plurality of portable staircases may be secured between said first and second portable staircases by attaching the siderail upper end to the siderail lower end of adjacent portable staircases.

15. The method of claim 12, wherein said fastening system includes a locking clamp, locking latches, fitted coupling, or nut and bolt fastener.

16. The method of claim 13, wherein said attachment conduits are operable to align and secure a handrail attachment to said siderail with a fastener.

17. The method of claim 12, wherein said securing said second portable staircase upper-end rail said upper surface of a trench with an anchoring fastener attached to a landing attachment.

18. The method of claim 17, wherein said landing attachment secures to said upper-end rail and includes a ground anchor.

19. The method of claim 12, wherein said steps have a textured surface to prevent a user from slipping.

20. The method of claim 12, wherein said staircases fit in the bed of a pickup truck.

* * * * *